US005512121A

United States Patent [19]

Brown, Jr.

[11] Patent Number: 5,512,121

[45] Date of Patent: Apr. 30, 1996

[54] METHOD OF MANUFACTURING A MOP

[76] Inventor: Arthur K. Brown, Jr., 2036 Greenleaf Blvd., Elkhart, Ind. 46514

[21] Appl. No.: 301,668

[22] Filed: Sep. 7, 1994

[51] Int. Cl.[6] ..... A47L 13/20

[52] U.S. Cl. ..... 156/257; 156/293; 15/119.2

[58] Field of Search ..... 15/115, 116.1, 15/116.2, 119.1, 244.1, 119.2; 156/257, 303.1, 293, 267

[56] References Cited

U.S. PATENT DOCUMENTS

| | | | |
|---|---|---|---|
| 4,875,246 | 10/1989 | MacGregor | 15/119.2 |
| 5,058,233 | 10/1991 | Davis, II | 15/244.1 |
| 5,381,579 | 1/1995 | Sartori | 15/116.2 X |

*Primary Examiner*—Michael W. Ball

*Assistant Examiner*—Sam Chuan Yao

*Attorney, Agent, or Firm*—Leo H. McCormick, Jr.

[57] ABSTRACT

A method of manufacturing a mop and in particular a mop head. The mop head is made from a rectangular piece of open cell sponge, a cylindrical core and a wringer assembly. A groove is cut along a longitudinal axis of the sponge while the external rectangular corners are also removed along the longitudinal axis to define a member with substantially five equal longitudinal surfaces. An adhesive is placed in the groove to join the cylindrical core with the open cell sponge. The wringer assembly has a strap which retains a roller which is attached to the cylindrical core to locate the roller at a fixed distance from the cylindrical core. A handle which is perpendicularly attached to the center of the cylindrical core has a tapered surface which provides a stop for the roller in the rest position.

6 Claims, 4 Drawing Sheets

METHOD OF MANUFACTURING A MOP

This invention relates to a method of manufacturing a mop from a rectangular sponge, a cylindrical core, wringer assembly and a handle. The rectangular sponge has a groove formed along a top surface for retaining the cylindrical core while at the same time edges of parallel side surface of the rectangular sponge are removed to define five longitudinal working surfaces of substantially equal width. The wringer assembly which attached To The cylindrical core has a roller which is moved in an arc to remove liquid from the sponge. A handle perpendicularly attached to the center of the cylindrical core completes the assembly of the mop.

BACKGROUND OF THE INVENTION

In U.S. Pat. No. 4,137,592 first and second methods are disclosed for manufacturing a mop. In the first method, a rectangular piece of sponge is glued to cylindrical core, a wringer assembly attached to the core and a handle joined to the cylindrical core to define a mop. In the second method, a core member is located inside of a cylindrical sponge and a handle attached thereto. In both of this methods of manufacture an adequate mop is produced, however under some circumstances after an extended period of time, the adhesive fails and the sponge separates from the cylindrical core. It has been suggested that part of the failure may occur because of a lack of pressure being applied when the sponge is attached to the cylindrical core. However if too much pressure is applied, the adhesive may be forced into some of the sponge and thereby reducing the effectiveness of the sponge to adsorb liquid.

SUMMARY OF THE INVENTION

From experience it has been determined that the most effective sponge for adsorption of liquid can not be extruded however rectangular sheets can be manufactured with a thickness of up to 2 feet without effecting the adsorption characteristics. Once the sheet has cured it can be cut into strips of varying width for many purposes. It is one of such strips from which the mop head of the present invention is manufacture according to the following steps: a sponge having a generally rectangular shape with a top surface separated from a bottom surface by a predetermined uniform thickness is obtained from a source. The sponge which has a first end separated from a second end by first and second parallel side surfaces is placed in a fixture and a groove is formed in the top surface along a plane parallel to the first and second side surfaces to create first and second lands on the top surface. After obtaining a cylindrical member from a source of supply, the groove is coated with a layer of adhesive and the cylindrical member is placed in the groove such that the ends thereof are aligned with the first and second ends of the sponge. The width of the groove is such that the resiliency of the sponge provides a force to hold the sponge against thee cylindrical member. The adhesive cured to affix the sponge to the cylindrical member. A first handle is obtained from a source and perpendicularly attached to the cylindrical member. Thereafter; a wringer assembly is obtained from a source and attached to the cylindrical member. The wringer assembly has a strap with a first end and a second end each having first and second holes a fixed distances from first and second ends to locate a roller a fixed distance from the first and second ends. The strap is secured to the cylindrical member by means to locate the roller parallel to the cylindrical member. One of the first and second lands acts on and urges the roller into engagement with the handle when the strap is in a first rest position. When an operator desires to remove liquid from the sponge, the strap is rotated in an arc to a second position to allow the roller to uniformly remove any liquid from the sponge.

It is an object of this invention to provide a method of manufacturing a mop head from a rectangular piece of sponge by forming groove to retain a cylindrical core and removing portions of parallel rectangular sides to define five equal width working surfaces.

It is a further object of this invention to define a mop having an open cell sponge head which is easily replaced while retaining a wringer assembly.

These and other objects should be apparent from reading this specification while viewing the drawings.

DETAILED DESCRIPTION OF THE INVENTION

Figure 1:
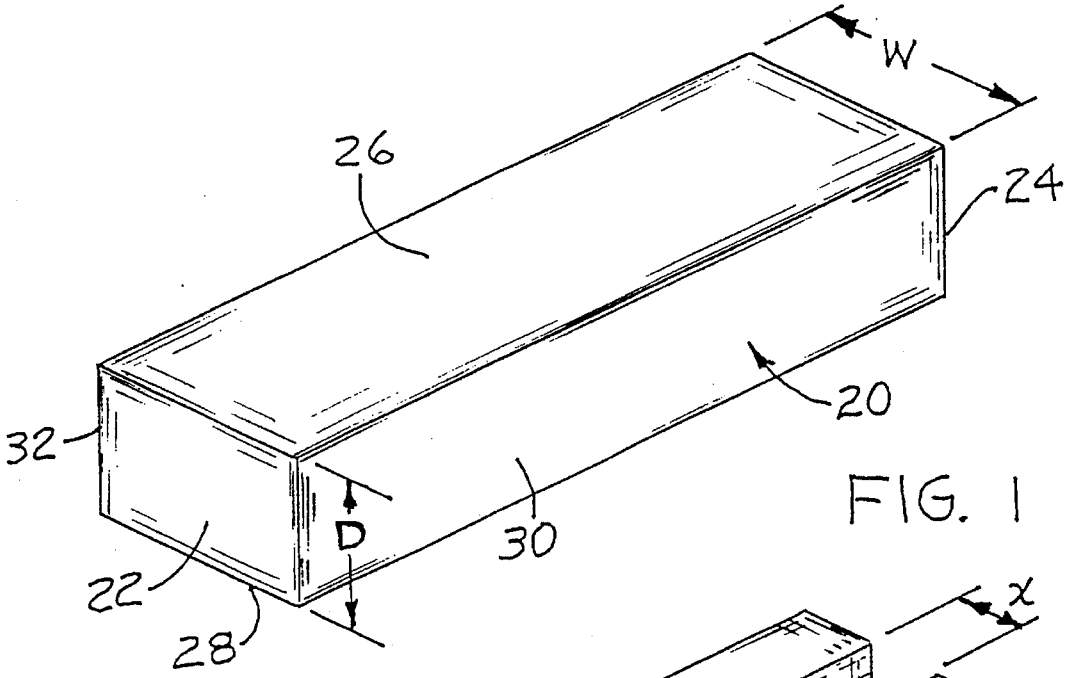
FIG. 1 is an illustration of a rectangular sponge member.
Figure 2:
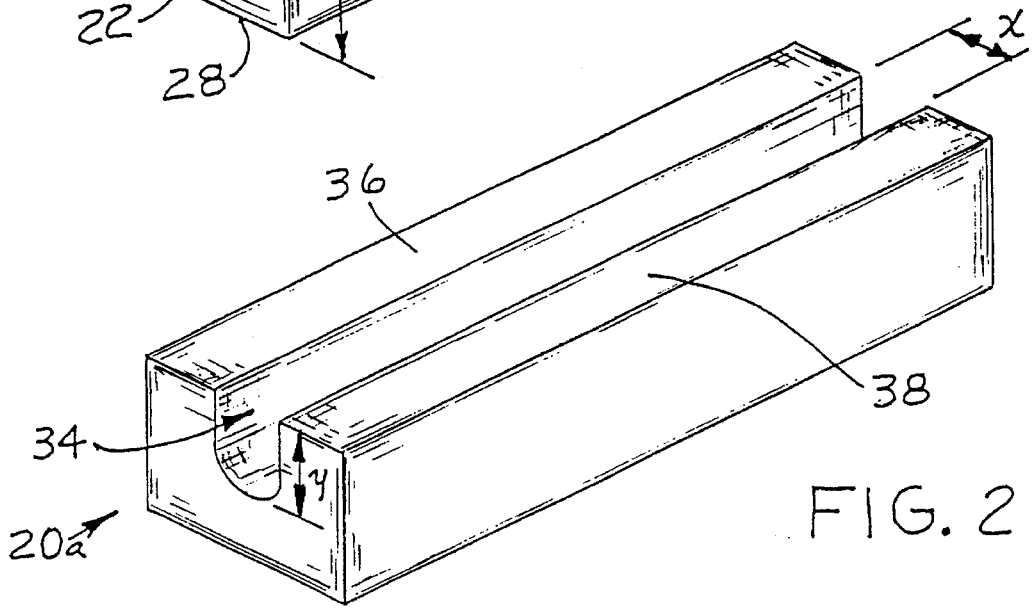
FIG. 2 is an illustration of the sponge member of FIG. 1 with a groove located in a top surface.

In U.S. Pat. No. 4,137,592 it is disclosed that removal of liquid from a sponge in a mop can approach 95% when a wringer is moved in an arc about a central core. The efficiency of liquid removal from a sponge is also a function of the composition of matter from which the sponge is manufactured. From experimentation it has been determined that open cell or coarse pore cellulose sponge material such as manufactured and sold by Spontex, Inc is effective for adsorption of liquid. Unfortunately such sponge can not with current technology be manufactured by an extrusion or molding processes but is manufactured in sheets from which pieces can be cut in various sizes and shapes. FIG. 1 is an illustration of a rectangular piece of sponge 20 which has been cut into a desired shape with a first end 22, a second end 24, a top surface 26, a bottom surface 28 and parallel side surfaces 30 and 32. Sponge 20 has a uniform thickness of "D" which in the present invention is about 1½ inches and a width of about 3 inches. A quantity of sponges 20 are cut to The desired dimensions and retained in storage until needed in the manufacture of mop heads which begins with the removal of a portion from the top surface 26 to create the blank 20*a* with groove 34 therein as shown in FIG. 2. Groove 34 which is parallel to sides 30 and 32 has a width "X" and a depth of "Y" such that the top surface 26 now has first 36 and second 38 lands. The depth Y of groove is selected such that it is about 20% larger than the width X.

Figure 3:
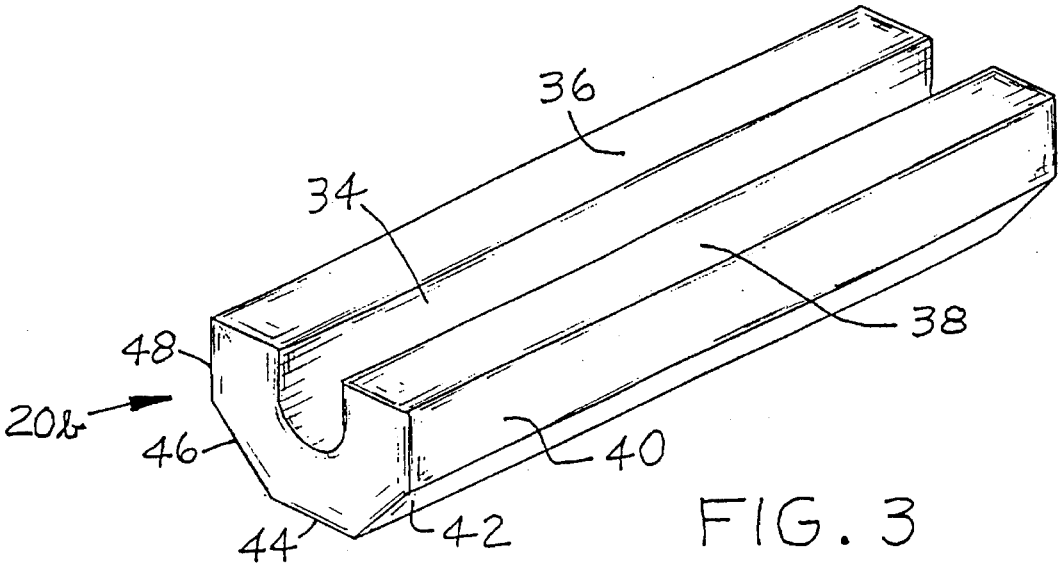
FIG. 3 is an illustration of the sponge member of FIG. 2 with portions removed from the longitudinal paralleled sides.
Figure 4:
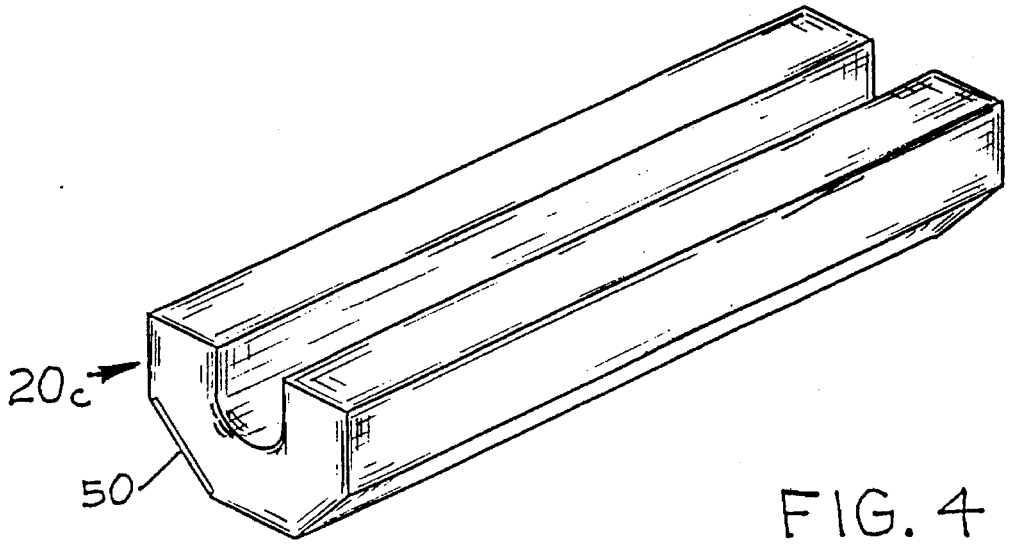
FIG. 4 is an illustration of the sponge member of FIG. 3 with a coating applied to a scouring surface on one work surface.

The blank 20*a* is further modified by the removal of the intersecting corners between the parallel side surfaces 30 and 30 and bottom surface 28 to create blank 20*b* as shown in FIG. 3 which has first 40, second 42, third 44, fourth 46 and fifth 48 peripheral longitudinal working surfaces. The working surfaces 40, 42, 44, 46, and 48 are substantially equal in width to provide symmetry while at thee same time retaining a sufficient volume of sponge to retain a desired amount of liquid. For some applications since the sponge material is rather soft and when used as a mop head it may be necessary to remove grit and grime that is attached to an object it is necessary to apply an abrasive coating 50 to one of the working surface to produce a blank 20*c* as shown in FIG. 4. The abrasive coating 50 can be sprayed on the surface is selected so as not to interfere with the absorption of liquid through the remaining working surfaces.

Figure 5:
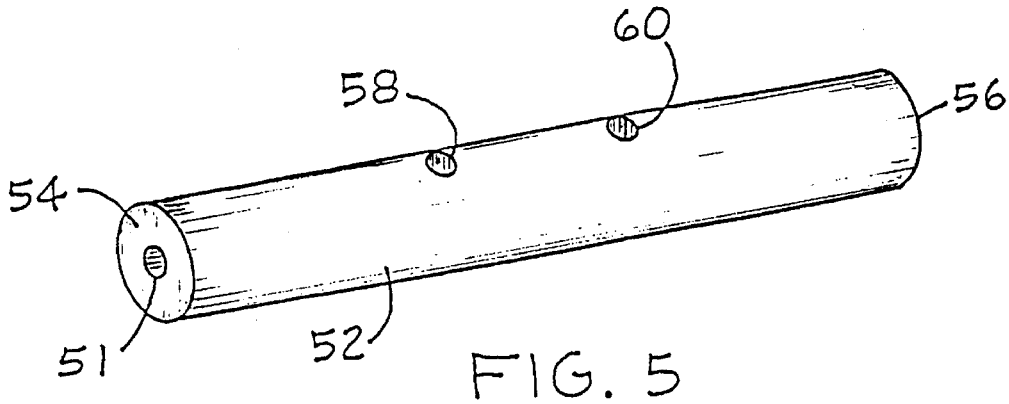
FIG. 5 is an illustration of a cylindrical core member.

A cylindrical core member 52 as shown in FIG. 5 is obtained from a source of supply. Core member 52 has a first end and a second end 56. The center of the core member 52 is located and first 58 and second 60 holes formed substantially equal distance from the center along a plane perpendicular to the cylindrical member and a first axial hole 51 is formed in end 54 and a second corresponding axial hole is formed in end 56.

Figure 6:
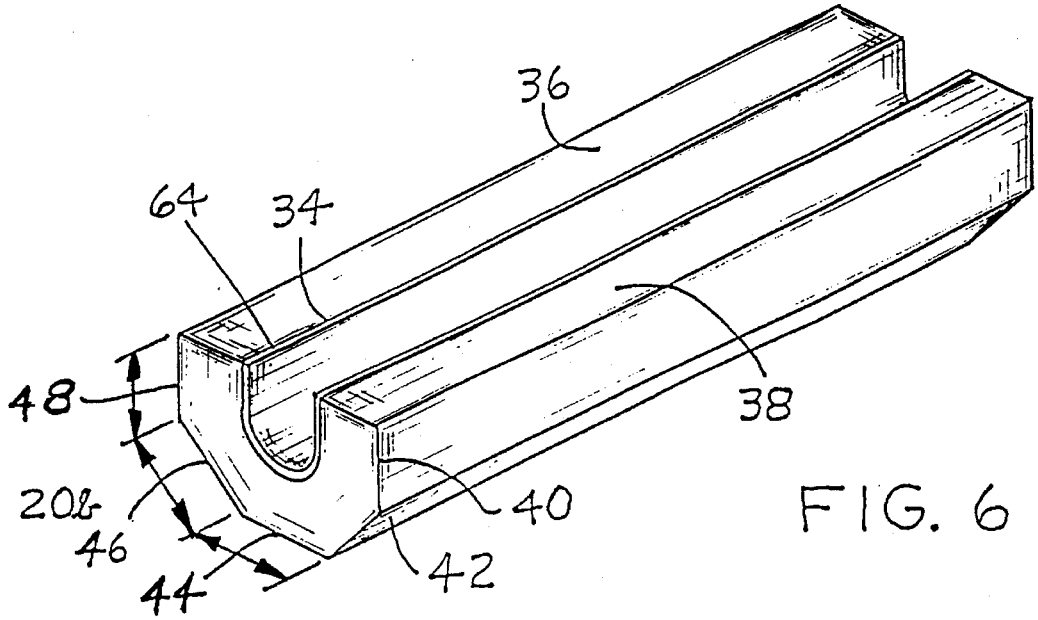
FIG. 6 is an illustration of the sponge of FIG. 3 with an adhesive applied to the groove in the top surface.
Figure 7:
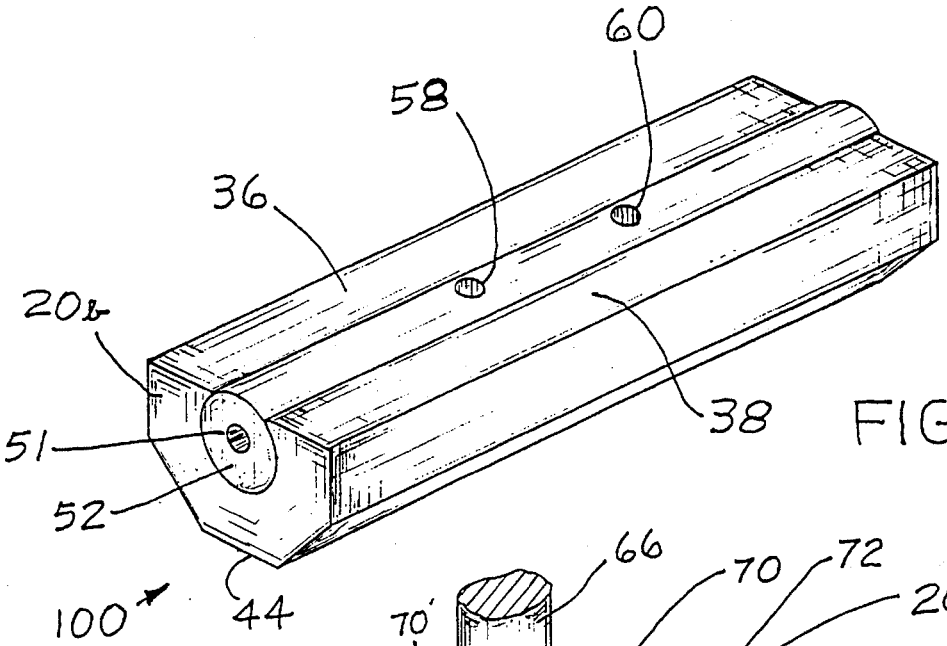
FIG. 7 is an illustration of the sponge of FIG. 6 with the core of FIG. 5 attached thereto define a mop head.

A layer of adhesive 64 is placed in groove 34 as shown in FIG. 6. The adhesive is basically a phenolic resin material which is water resistant and readily adheres to both the sponge material in blank 20*b* and the core member 52 which can be either a wood material or plastic. The core member 52 is placed in groove 34 as shown in FIG. 7 with the first end 54 aligned with the end 22 and the second end 56 aligned with end 24 of sponge blank 20*b* . In addition, holes 58 and 60 are located in a position perpendicular to surface 44 on sponge 20*b* and along a plane that equally divides the first land 36 from the second land 38. Since the diameter of core member 52 and groove 34 enhances the bond that is created between sponge blank 20*b* and core member 52, when the adhesive is cured, a head member 100 as shown in FIG. 7 is produced.

Figure 8:
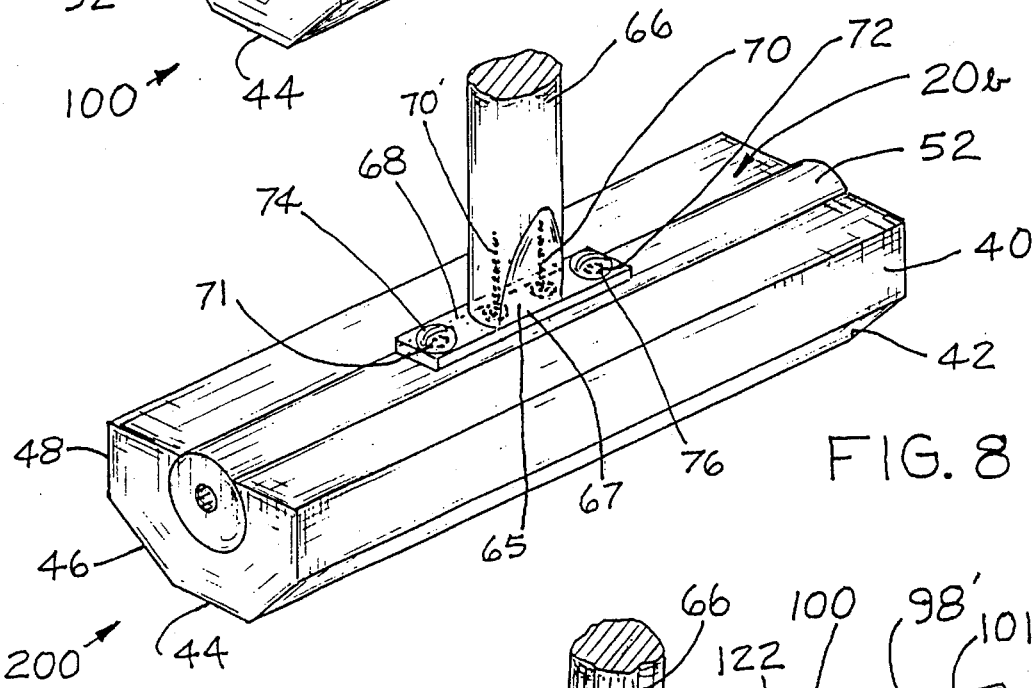
FIG. 8 is an illustration of mop head of FIG. 7 with a handle attached thereto.

In a separate step, a handle 66 is obtained from a source. Handle 66 is essentially a cylindrical pole with a parallel tapered surfaces 65,65' on end 67. End 67 is attached to a bracket or strap 68 by screws 70,70' as shown in FIG. 8. Bracket 68 has first and second holes 71 and 72 which are located an equal distance from the axial center of handle 66 and when screws 74 and 76 are screwed into pilot holes 58 and 60 in core member 52, a mop 200 is produced. In the present application, handle 66 is made of wood and bracket 68 is made of aluminum, however it is envisoned that the handle 66 and strap 68 could be made of a single part through a plastic molding procedure.

For some applications mop 200 will perform in an adequate manner such as spreading liquid on a surface however when it is desired to pick up liquid a wringer assembly 90 is added to mop 200.

Figure 9:
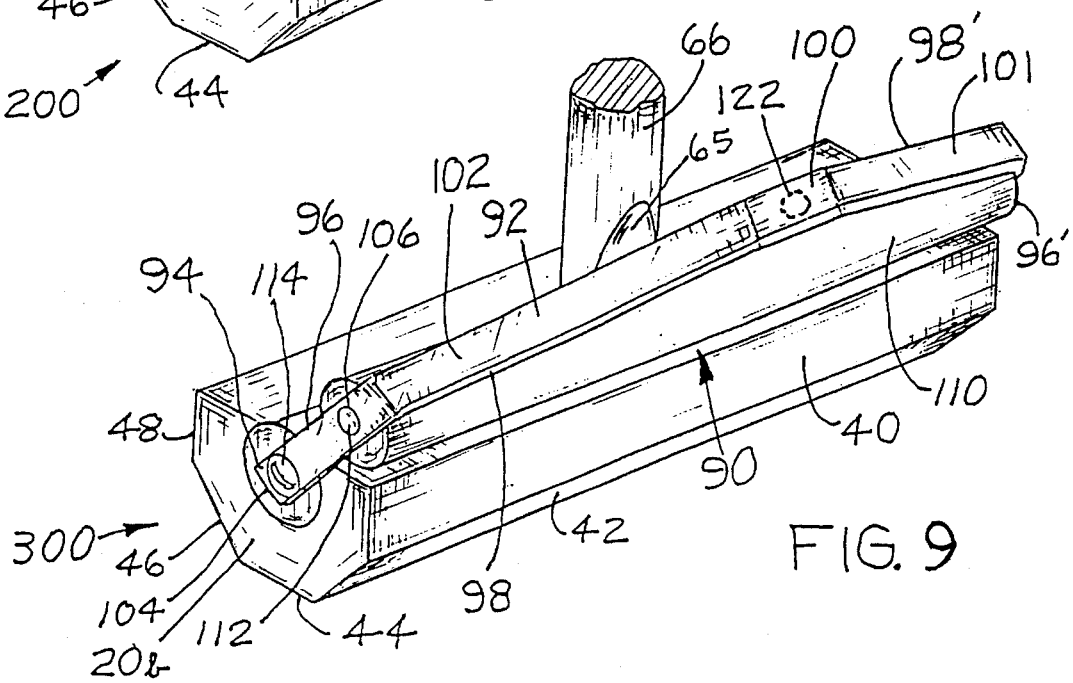
FIG. 9 is an illustration of the mop head and handle of FIG. 8 with a wringer assembly attached thereto.

Wringer assembly 90 is made up of a subassembly procedure starting with a strap 92 which has a first end 94 and a second end, not shown. Strap 92 has identical first and second sides 98,98' that extend from the first 94 and second ends with parallel section 96,96' that are connected to a center section 100 by angled sections 102,102'. The first and second sides 98,98' each have holes 104 and 106 located at a fixed distance apart such which is a function of the thickness of sponge blank 20*b* , the diameter of core member 52 and a roller 110. A roller 110 obtained from a source is attached to strap 92 by pins 112 which extend through holes 106, 106. Thereafter, strap 92 is joined to core member 52- by aligning holes 104, 104' with pilot holes 51, 51' located along the axial center of core member 52 and fasteners 114, 114' screwed into pilot holes 51, 51' to produce mop 300 shown in FIGS. 9 and 10. It should be noted that with strap 92 located against handle 66, roller 110 rests on land 38 and the internal resiliency of the sponge blank 20*b* is sufficient to maintain center surface 100 against the tapered surface on handle 66.

When strap 92 is rotated in an arc about the axial center core member 52 from land 38 to land 36, liquid is removed from the body of sponge as roller 110 sequentially engages working surfaces 40, 42, 44, 46 and 48.

Figure 10:
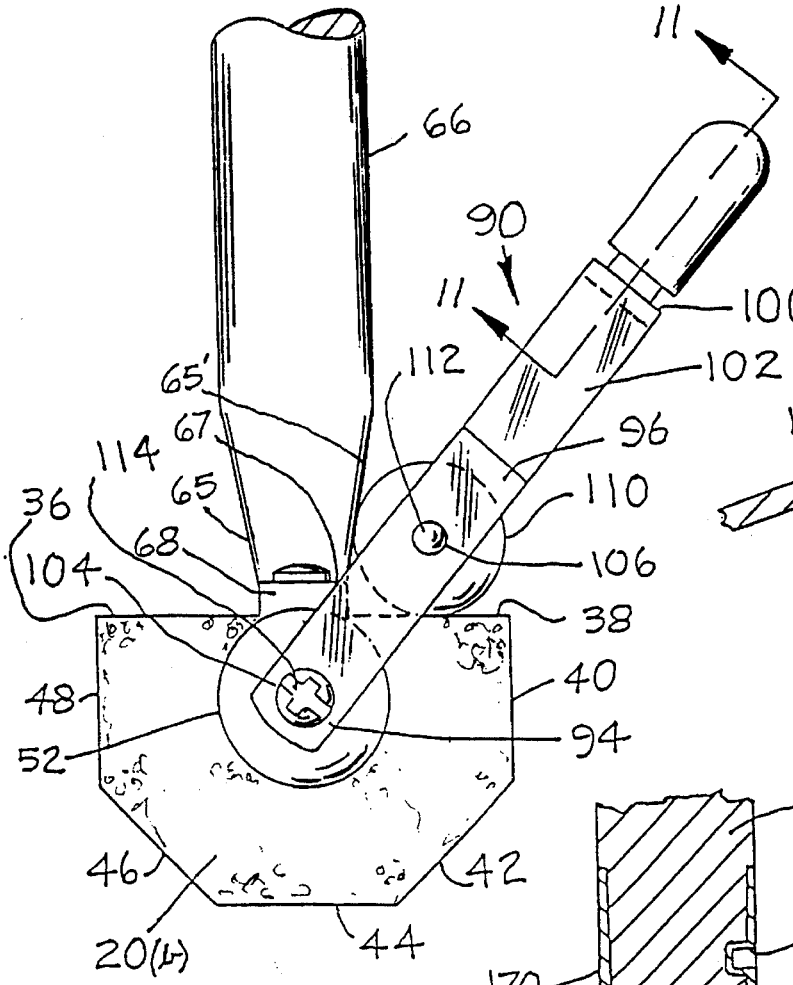
FIG. 10 is an end view of the mop of FIG. 9.
Figure 11:
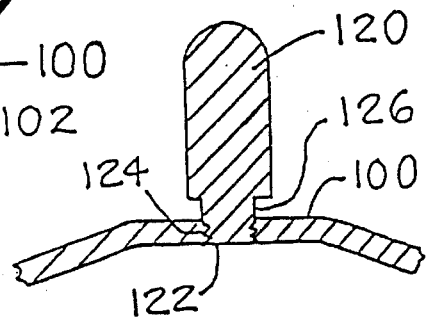
FIG. 11 is a sectional view taken along line 11—11 of FIG. 10.

Under some circumstances as roller 110 moves in the arc from a first position to a second position as shown in FIG. 10, liquid may drip on strap 92 and as a result the hand of a person using mop 300 may engage the liquid. In order to reduce the likelihood liquid contacting the person, a second handle 120 as best shown in FIG. 11 is attached to surface 100 by screwing threads 124 into opening 122. Handle 120 has a drip groove 126 which is located adjacent surface which will intercept liquid that may be on the strap 92 prior to being communicated to handle 120. It should be understood that strap 96 and handle 120 could be combined into one piece through a plastic molding procedure.

Figure 12:
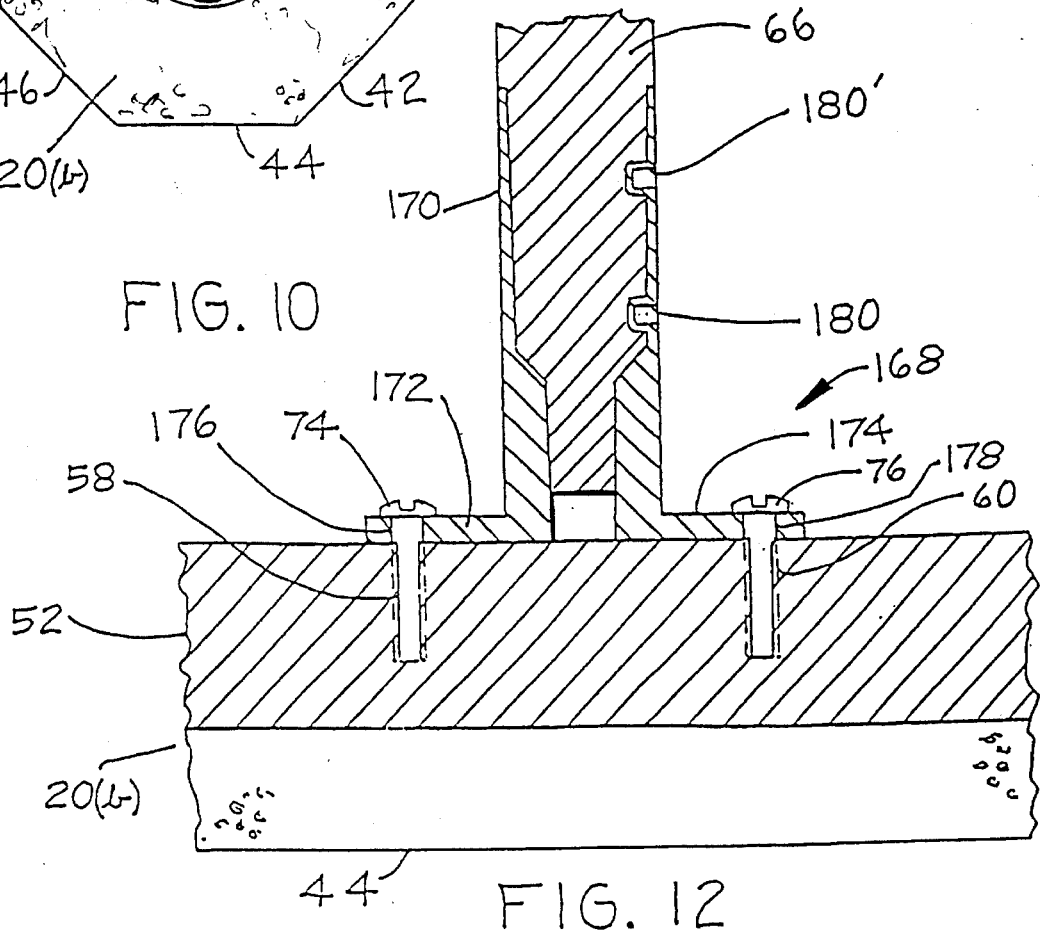
FIG. 12 is an sectional view of an alternate attachment for the handle and the cylindrical core member of a mop.

A feature of this invention is the interchangeable of the components that make up the resulting mop 300. To reduce the cost of the handle 66, a different bracket assembly 168 was devised to join handle 66 to core member 52, as shown in FIG. 12. Bracket assembly 168 has a cylindrical tube 170 with flanges 172 and 174 extending therefrom to form a base and openings 176, 178 in flanges 172 and 174, respectively. Handle 66 is placed in tube 170 and a force applied to the sides of tube 170 to form indentations 180,180' which extend into handle 66 and join the bracket 168 to handle 66. Thereafter handle 66 is attached to core member 52 as described above.

I claim:

1. A method of manufacturing a mop comprising the steps of:

obtaining a sponge from a source of supply, said sponge having a generally rectangular shape with a top surface separated from a bottom surface by a predetermined uniform thickness, said sponge having a first end separated from a second end by first and second parallel side surfaces;

forming a groove in said top surface along a plane parallel to said first and second side surfaces to create first and second lands;

applying a layer of adhesive to said sponge in said groove;

obtaining a cylindrical member from a source of supply, said cylindrical member having a first end and a second end;

placing said cylindrical member in said groove such that said first and second ends thereof are aligned with the first and second ends of said sponge;

curing said adhesive to affix said sponge to said cylindrical member;

attaching a first handle to said cylindrical member;

obtaining a wringer assembly from a source, said ringer assembly having a strap with a first end and a second end, said strap having a first side adjacent said first end and a second side adjacent said second end, said first side and second side being connected to a center section, said first and second sides each having first and second holes a fixed distances from first and second ends;

obtaining a roller from a source of supply;

securing said roller to said strap by means extending through said second holes in said first and second sides; and securing said strap to said cylindrical member by means extending through each of said first holes in said first and second sides of said strap such that said roller is parallel to said cylindrical member, one of said first and second lands acting on and urging said roller into engagement with said first handle when said strap is in a first rest position, said strap being adapted to rotate in an arc to a second position to uniformly remove any liquid from said sponge where the other of said first and second lands act on and urge said roller into engagement with said first handle.

2. The method manufacturing a mop as recited in claim 1 further including the step of:

removing the intersecting corners between said parallel side surfaces and bottom surface on said sponge to create first, second, third, fourth and fifth peripheral longitudinal working surfaces, said working surfaces being substantially equal in width to provide symmetry and aid in the removal of liquid from the sponge on movement of said wringer assembly.

3. The method as recited in claim 2 further including the step of:

applying a coating to at least one of said peripheral working surfaces, said coating including an abrasive particle to create a different surface on said working surfaces.

4. The method as recited in claim 3 further including the step of:

attaching a second handle to said center section of said strap, said second handle having a groove located adjacent said center section to divert any liquid away from the second handle that may communicated from said sponge by way of said strap.

5. The method as recited in claim 4 wherein said step of attaching said first handle to said cylindrical member includes the steps of:

locating the center of said cylindrical member;

forming first and second holes substantially equal distance from said center and along a plane perpendicular to said cylindrical member;

obtaining a bracket from a source, said bracket having a base with a tube extending therefrom; attaching said bracket to said cylindrical member by fastener member being inserted through said base and into said first and second holes; and screwing a pole into said tube.

6. The method as recited in claim 4 wherein said step of attaching said first handle to said cylindrical member includes the steps of:

locating the center of said cylindrical member;

forming first and second holes substantially equal distance from said center and along a plane perpendicular to said cylindrical member;

obtaining a bracket from a source, said bracket having a base with a tube extending therefrom; attaching said bracket to said cylindrical member by fastener member being inserted through said base and into said first and second holes;

locating a handle in said tube; and staking said handle to said tube.

* * * * *